US008410983B2

(12) United States Patent
Tsai et al.

(10) Patent No.: US 8,410,983 B2
(45) Date of Patent: Apr. 2, 2013

(54) WIDE-BAND ANTENNA

(75) Inventors: Yung-Chih Tsai, Taipei (TW); Jia-Hung Su, Taipei (TW); Kai Shih, Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 317 days.

(21) Appl. No.: 13/005,527

(22) Filed: Jan. 12, 2011

(65) Prior Publication Data

US 2012/0176274 A1 Jul. 12, 2012

(51) Int. Cl.
*H01Q 1/38* (2006.01)

(52) U.S. Cl. ..... 343/700 MS; 343/702; 343/846; 343/848

(58) Field of Classification Search ..... None
See application file for complete search history.

(56) References Cited

U.S. PATENT DOCUMENTS

| | | | | |
|---|---|---|---|---|
| 6,573,867 | B1 * | 6/2003 | Desclos et al. | 343/700 MS |
| 6,870,504 | B2 * | 3/2005 | Ikegaya et al. | 343/700 MS |
| 8,299,972 | B2 * | 10/2012 | Lai | 343/702 |
| 2008/0278389 | A1 * | 11/2008 | Su et al. | 343/722 |
| 2012/0169563 | A1 * | 7/2012 | Tsai et al. | 343/848 |

* cited by examiner

*Primary Examiner* — Trinh Dinh
(74) *Attorney, Agent, or Firm* — Lin & Associates IP, Inc.

(57) ABSTRACT

A wide-band antenna mounted on a circuit board includes a ground plate, a radiating plate perpendicularly connected to two side edges of the circuit board, and a planar antenna element which includes a base plate, an extending plate, and a ground portion. One side of the base plate defines a gap with a first coupling portion being formed, and a slot adjacent to the gap with a first strip being formed therebetween. A second strip is extended perpendicularly from the first strip. The extending plate is extended outward from one end of the base plate. The ground portion is extended outward from the second strip and connected to the ground plate. The first coupling portion and the ground portion have an interspace to form a capacitive coupling therebetween. A groove is formed among the first and second strips and the ground portion to form a simulation inductance thereamong.

5 Claims, 1 Drawing Sheet

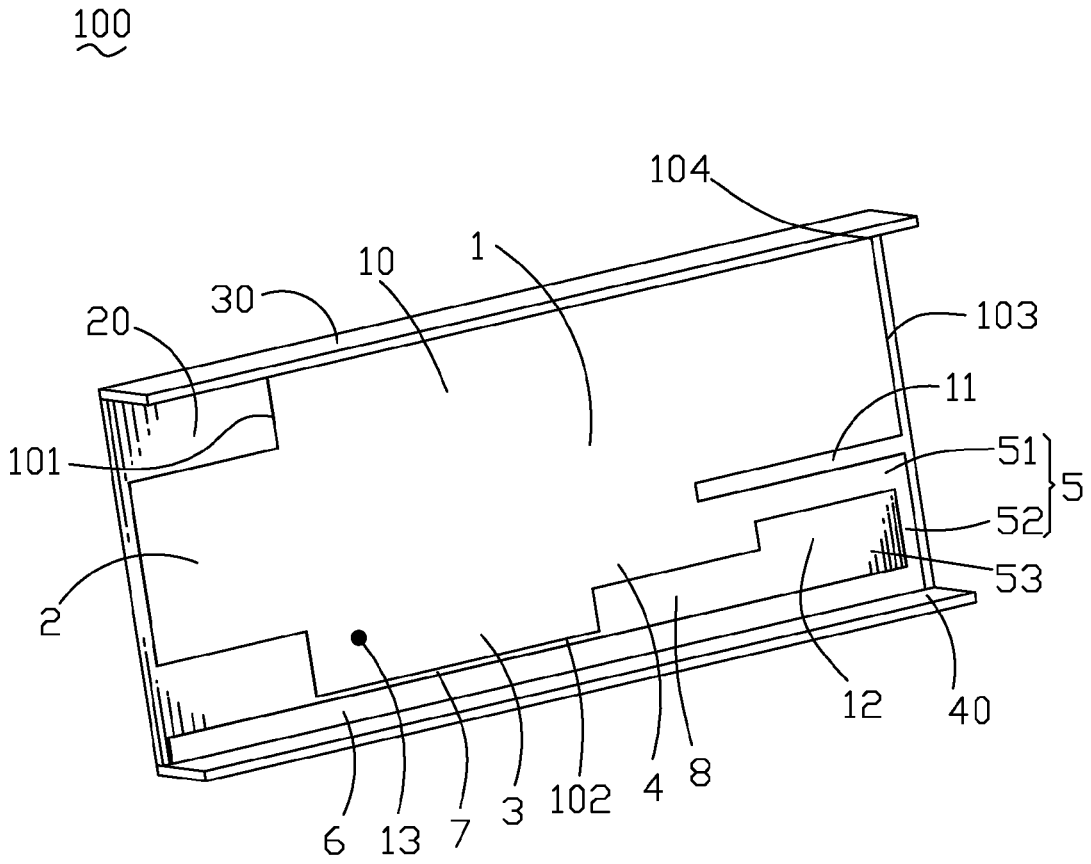
100
104
1
10
30
20
103
11
101
51
5
52
53
2
12
40
6
13
7
3
102
4
8

WIDE-BAND ANTENNA

BACKGROUND OF THE INVENTION

1. Field of the Invention

The present invention relates to a wide-band antenna, and more particularly to a wide-band antenna having a simple structure capable of saving occupied space and manufacturing cost thereof.

2. The Related Art

With the fast development of wireless technology, different wireless standards are instituted according to the need of the market and application mode, such as a standard of IEEE 802.15 used in (Personal Area Network, PAN), a standard of IEEE 802.11 used in (Wireless Area Network, WLAN), and a standard of IEEE 802.16 used in (Metropolitan Area Network, MAN).

The IEEE 802.16 standard can be a fixed broadband wireless access standard or a mobile broadband wireless access standard. After the mobile broadband wireless access standard is instituted, WIMAX (Worldwide Interoperability for Microwave Access) is established by advanced communicating equipment companies. The consistency certification and interoperability certification of wide-band wireless access products based on IEEE 802.16 standard is one of working contents of WIMAX (Worldwide Interoperability for Microwave Access). With the standardization of the IEEE 802.16 is completed, more and more WIMAX antennas have been used in the electronic products, such as notebooks.

However, in order to satisfy the need of receiving and transmitting frequency bandwidth of the WIMAX antenna, occupied space of the WIMAX is generally larger. Moreover, the structure of the current WIMAX antenna is complex, and a new die need to be designed, all increase the manufacturing cost.

SUMMARY OF THE INVENTION

An object of the present invention is to provide a wide-band antenna mounted on a circuit board. The wide-band antenna includes an elongated ground plate, a radiating plate and a planar antenna element. The ground plate is perpendicularly connected to one side edge of the circuit board. The radiating plate is perpendicularly connected to the other side edge of the circuit board and facing to the ground plate. The planar antenna element disposed on the circuit board includes a base plate, an extending plate, and a ground portion. The base plate has a first longitudinal edge and a second longitudinal edge opposite to each other, a first transverse edge and a second transverse edge opposite to each other. The first longitudinal edge is spaced from and adjacent to the ground plate. The second longitudinal edge is connected to an inside of the radiating plate. One end of the first longitudinal edge defines a long gap extending longitudinally to penetrating the second transverse edge, and then a longitudinal first coupling portion is correspondingly formed. The base plate defines a longitudinal slot adjacent to the gap and penetrates the second transverse edge. A first strip is formed between the gap and the longitudinal slot. A second strip is extended perpendicularly to approach to the ground plate from a distal end of the first strip. An inductance portion is formed by the first strip and the second strip. The extending plate is extended outward from a substantially middle portion of the first transverse edge. The elongated ground portion is extended in the same direction as the extending plate from a distal end of the second strip and connected to an inside of the ground plate. The first coupling portion and the ground portion have a narrow and long interspace to form a capacitive coupling therebetween. A groove is formed among the first strip, the second strip and the ground portion to form a simulation inductance thereamong.

As described above, the base plate being connected to the radiating plate and the ground portion being connected to the ground plate can decrease occupied space of the wide-band antenna. Furthermore, the wide-band antenna has a simple structure of mounting the radiating plate, the ground plate and the antenna element on the circuit board directly, and a die needn't be opened so as to save the manufacturing cost of the wide-band antenna.

BRIEF DESCRIPTION OF THE DRAWINGS

The present invention will be apparent to those skilled in the art by reading the following description, with reference to the attached drawings, in which:

FIG. 1 is a perspective view illustrating the structure of a wide-band antenna of an embodiment in accordance with the present invention.

DETAILED DESCRIPTION OF THE PREFERRED EMBODIMENT

Referring to FIG. 1, an embodiment of a wide-band antenna 100 according to the present invention is shown. The wide-band antenna 100 mounted on a circuit board 20 may be formed by pattern etching a copper-plated sheet of synthetic material. The wide-band antenna 100 includes a planar antenna element 10, a radiating plate 30 and a ground plate 40. The antenna element 10 can connect with a radiating circuit of a portable mobile communication equipment by a feed cable (not shown).

Referring to FIG. 1, the radiating plate 30 is used for receiving and transmitting low-frequency electromagnetic signals. The radiating plate 30 is of an elongated plate shape and perpendicularly connected to one side edge of the circuit board 20. The ground plate 40 is of an elongated plate shape and perpendicularly connected to the other side edge of the circuit board 20. The ground plate 40 is parallel to and faces to the radiating plate 30.

Referring to FIG. 1 again, the planar antenna element 10 mounted on the circuit board 20 includes a base plate 1, an extending plate 2, a first coupling portion 3, a second coupling portion 4 and an inductance portion 5 and a ground portion 6 which are coplanar with one another. The base plate 1 is of a rectangular plate shape, and has a first transverse edge 101, a second transverse edge 103 parallel to the first transverse edge 101 and opposite to the first transverse edge 101, and a first longitudinal edge 102 and a second longitudinal edge 104 both connecting with the first and second transverse edges 101,103 and opposite to each other. The second longitudinal edge 104 is connected to an inner side of the radiating plate 30 to increase electric length of the base plate 1 so as to increase receiving and transmitting frequency bands of the base plate 1, and decrease occupied space of the wide-band antenna 100. The first longitudinal edge 102 is spaced from and adjacent to the ground plate 40.

One end of the first longitudinal edge 102 defines a long gap 12 extending longitudinally to penetrating the second transverse edge 103, and a longitudinal first coupling portion 3 is correspondingly formed. The base plate 1 defines a longitudinal slot 11 adjacent to the gap 12 and penetrating the second transverse edge 103. A first strip 51 is formed between the gap 12 and the longitudinal slot 11. A second strip 52 is extended perpendicularly to approach to the ground plate 40 from a distal end of the first strip 51, an inductance portion 5 is formed by the first strip 51 and the second strip 52. The extending plate 2 is extended outward from a substantially middle portion of the first transverse edge 101. An elongated ground portion 6 is extended in the same direction as the extending plate 2 from a distal end of the second strip 52 and connected to an inside of the ground plate 40. A distal end of the ground portion 6 is in alignment with a distal end of the extending plate 2. The first coupling portion 3 and the ground portion 6 have a narrow and long interspace 7 to form a capacitive coupling therebetween for tuning resonance frequency and high-frequency impedance matching of the wide-band antenna 100. A groove 53 is formed among the first strip 51, the second strip 52 and the ground portion 6 to form a simulation inductance thereamong for tuning bandwidth and input impedance of the wide-band antenna 100 to realize impedance matching between the wide-band antenna 100 and the feeding cable (not shown). So that return loss is reduced, and receiving and emitting performance of the wide-band antenna 100 at the lower-frequency signal is improved. In the case, an inside longitudinal edge of the gap 12 is extended outward to form a second coupling portion 4 which shows a longitudinal strip shape connected to an inside of the first coupling portion 3 and spaced away from the second strip 52. An interspace 8 bigger than the interspace 7 between the ground portion 6 and the first coupling portion 3 is formed between the ground portion 6 and the second coupling portion 4 for forming a capacitive coupling therebetween to tune resonance frequency and high-frequency impedance matching of the wide-band antenna 100. An inner end of the slot 11 is beyond an end of the second coupling portion 4 nearer to the second strip 52. The first coupling portion 3 defines a feeding point 13 adjacent to the extending plate 2.

When the wide-band antenna 100 is assembled in a mobile communication equipment, the ground plate 40 is connected to the ground. Then the ground portion 6 is connected with the ground through the ground plate 40. Because the inductance portion 5 is a narrow strip metal, the inductance portion 5 has a property of linearity. Therefore, the connection between the inductance portion 5 and the ground plate 40 can substitute for an inductor to attain the same function. The first coupling portion 3 and the second coupling portion 4 is respectively a long narrow strip spaced from the ground plate 40, so the first coupling portion 3 and the second coupling portion 4 and the ground plate 40 produce a capacitance effect and can substitute for a capacitor to attain the same function.

When the wide-band antenna 100 is used in wireless communication, an electric current is fed into the wide-band antenna 100 via the feeding point 13. The base plate 1 produces a main resonance with an electromagnetic wave to receive and transmit electromagnetic signals with a low frequency band range covering 2.3 GHZ to 3.8 GHZ in the wireless communication. The extending plate 2 produces a main resonance with an electromagnetic wave to receive and transmit electromagnetic signals with a high frequency band range covering 5.15 GHZ to 5.85 GHZ in the wireless communication.

As described above, the second longitudinal edge 104 of the base plate 1 being connected to the inner side of the radiating plate 30 and the ground portion 6 being connected to the inner side of the ground plate 40 can decrease occupied space of the wide-band antenna 100. Furthermore, the wide-band antenna 100 has a simple structure of mounting the antenna element 10, the radiating plate 30 and the ground plate 40 on the circuit board 20 directly, and a die needn't be opened so as to save the manufacturing cost of the wide-band antenna 100.

What is claimed is:

1. A wide-band antenna mounted on a circuit board, comprising:

an elongated ground plate perpendicularly connected to one side edge of the circuit board;

an elongated radiating plate perpendicularly connected to the other side edge of the circuit board and facing to the ground plate; and a planar antenna element disposed on the circuit board, comprising a substantially base plate having a first longitudinal edge and a second longitudinal edge opposite to each other, a first transverse edge and a second transverse edge opposite to each other, the first longitudinal edge spaced from and adjacent to the ground plate, the second longitudinal edge connected to an inside of the radiating plate, one end of the first longitudinal edge defining a long gap extending longitudinally to penetrating the second transverse edge, and a longitudinal first coupling portion being correspondingly formed, the base plate defining a longitudinal slot adjacent to the gap and penetrating the second transverse edge, a first strip formed between the gap and the longitudinal slot, a second strip extended perpendicularly to approach to the ground plate from a distal end of the first strip, an inductance portion formed by the first strip and the second strip;

an extending plate extended outward from a substantially middle portion of the first transverse edge; and an elongated ground portion extended in the same direction as the extending plate from a distal end of the second strip and connected to an inside of the ground plate, the first coupling portion and the ground portion having a narrow and long interspace to form a capacitive coupling therebetween, a groove being formed among the first strip, the second strip and the ground portion to form a simulation inductance thereamong.

2. The wide-band antenna as claimed in claim 1, wherein an inside longitudinal edge of the gap is extended outward to form a second coupling portion which shows a longitudinal strip shape connected to an inside of the first coupling portion and spaced away from the second strip, an interspace bigger than the interspace between the ground portion and the first coupling portion is formed between the ground portion and the second coupling portion for forming a capacitive coupling therebetween.

3. The wide-band antenna as claimed in claim 2, wherein an inner end of the slot is beyond an end of the second coupling portion nearer to the second strip.

4. The wide-band antenna as claimed in claim 1, wherein the first coupling portion defines a feeding point adjacent to the extending plate.

5. The wide-band antenna as claimed in claim 1, wherein a distal end of the ground portion is in alignment with a distal end of the extending plate.

* * * * *